United States Patent [19]

Cahuzac

[11] Patent Number: 4,805,422

[45] Date of Patent: Feb. 21, 1989

[54] MACHINE FOR KNITTING COMPOSITE REINFORCEMENTS

[75] Inventor: Georges J. J. Cahuzac, Saint Jean d'Illac, France

[73] Assignee: Societe Nationale Industrielle et Aerospatiale, France

[21] Appl. No.: 157,573

[22] Filed: Feb. 17, 1988

[30] Foreign Application Priority Data

Feb. 17, 1987 [FR] France ..... 87 02013

[51] Int. Cl.[4] ..... D04B 9/12

[52] U.S. Cl. ..... 66/13; 139/387 R

[58] Field of Search ..... 66/13, 11, 10; 139/11, 139/22, 4, 387 R

[56] References Cited

U.S. PATENT DOCUMENTS

| | | | |
|---|---|---|---|
| 4,183,232 | 1/1980 | Banos et al. | 66/11 |
| 4,346,741 | 8/1982 | Banos et al. | 139/387 R |
| 4,393,669 | 7/1983 | Cahuzac | 66/13 |
| 4,492,096 | 1/1985 | Cahuzac | 66/11 |

*Primary Examiner*—Ronald Feldbaum

*Attorney, Agent, or Firm*—McGlew and Tuttle

[57] ABSTRACT

In this machine, rows of rods ($R_1^2$, $R_3^2$, $R_4^3$, $R_2^3$) representing the woof threads are circulated in passages A, B, C defined between filaments (86) forming concentric open loops having adjustable diameters. In the openings of the loops are needles (90) movable between neutral or open positions for deviating the rods from a passage into an adjacent passage while depositing warp threads in circular layers between the rods. The rods are then replaced by woof threads by a lacing device.

14 Claims, 15 Drawing Sheets

MACHINE FOR KNITTING COMPOSITE REINFORCEMENTS

The present invention generally relates to the manufacture of composite reinforcements of threads or fibers impregnated with resin and woven in more than two dimensions and it more particularly concerns a novel machine for weaving such reinforcements.

Composite reinforcements woven in three dimensions are well known and widely used and the same is true of many machines for weaving such reinforcement elements.

The applicant has invented a reinforcement having a novel texture described and claimed in the French patent application 87/02012 filed Feb. 17, 1987 for "Woven Reinforcement for a Composite Material".

This reinforcement, formed by woof threads and warp threads, has a texture formed by a basic pattern constituted by fifteen woof threads R in a staggered arrangement, forming six columns 1 to 6 of alternately two and three threads and at least five lines 1 to 5 perpendicular to said columns and each having three threads, and by six imbricated layers C1 to C6 of at least two parallel warp threads, namely at least twelve threads a, b, c, . . . 1, each connecting every third woof thread of the same column in two adjacent lines and the warp threads of consecutive layers connecting woof threads in alternating columns, the first thread a of the first layer C1 connecting the woof thread R of column 2 in line 1, namely $R_1^2$ to the woof thread R of column 5 in line 2, namely $R_2^5$; the second thread b of the first layer C1 connecting the woof thread R of column 2 in line 3, namely $R_3^2$, to the woof thread R of column 5 in line 4, namely $R_4^5$; the first thread c of the second layer C2 connecting the woof thread R of column 1 in line 2, namely $R_2^1$, to the woof thread R of column 4, in line 1, namely $R_1^4$; the second thread d of the second layer C2 likewise connecting the woof threads $R_4^1$ and $R_3^4$ the paths of the threads of the following layers C3, . . . C6 being obtained by adding 2 to each preceding corresponding column reference, namely, for the first thread of layer $C3=R_2^{1+2}=R_2^3$ and $R_1^{4+2}=R_1^6$, etc , said pattern being capable of being enlarged in the direction of the thickness of the material to be produced, with an uneven number of lines.

U.S. Pat. Nos. 4,183,232 and 4,346,741 which are incorporated herein disclose a machine for weaving in three dimensions a composite reinforcement element comprising a frame formed by a base carrying a plurality of vertical guide columns on which horizontal frames are slidably mounted and engaged with rotary lead-screws for raising or lowering these frames.

Plates are rotatively mounted on these frames and are perforated in a plurality of circular and radial rows with orifices in which are disposed corresponding rows of vertical metal rods which also extend through corresponding rows of orifices formed in at least two horizontal disks located between said frames and suspended from the upper frame by chains.

Fixed in the upper part of the machine is a knitting device comprising, among other elements, an annular member having radial notches in which are slidable bars adapted to be raisable, a pressure plate including a coating having a low coefficient of friction, and a device for recycling said bars.

This known machine is completed by a lacing device for replacing the metal support rods of the knitted element by threads, such a disclosed in U.S. Pat. No. 4,393,669.

The invention provides a machine for knitting composite reinforcements with woof threads and warp threads having a texture formed by a basic pattern constituted by fifteen woof threads R arranged in staggered relation forming six columns 1 to 6 of alternately two and three threads and at least five lines 1 to 5 perpendicular to said columns and each having three threads, and by six imbricated layers C1 to C6 of at least two parallel warp threads, namely at least twelve threads a, b, c . . . 1 each connecting every third woof thread of the same column in two adjacent lines and the warp threads of the consecutive layers connecting woof threads in alternated columns, the first thread a of the first layer C1 connecting the woof thread R of column 2 in line 1, namely $R_1^2$ to the woof thread R of column 5 in line 2, namely $R_2^5$; the second thread b of the first layer C1 connecting the woof thread R of column 2 in line S, namely $R_3^2$, to the woof thread R of column 5 in line 4, namely $R_4^5$; the first thread c of the second layer C2 connecting the woof thread R of column 1 in line 2, namely $R_2^1$, to the woof thread R of column 4 in line 1, namely $R_1^4$; the second thread d of the second layer C2 likewise connecting the woof threads $R_4^1$ and $R_3^4$, the paths of the threads of the following layers C3 . . . C6 being obtained by adding 2 to each preceding corresponding column reference, namely, for the first thread of layer $C3=R_2^{1+2}=R_2^3$ and $R_1^{4+2}=R_1^6$, etc., this pattern being capable of being enlarged in the direction of the thickness of the material to be produced with an uneven number of lines, said machine being of the type comprising a frame having a plurality of vertical columns, horizontal frames spaced apart one above the other and in guided relation to the columns, rotary disks provided with circular rows of radially aligned orifices and carried by the frames, corresponding rows of N vertical rods disposed in the orifices, and a knitting apparatus mounted in an upper part of said columns and comprising an annular ring having radial grooves, bars slidably mounted the grooves, an annular pressure plate for maintaining said bars, and a device for recycling the said bars, said machine comprising in an upper part thereof a fixed frame, means carried by the frame and defining therebetween horizontal concentric passages in which respectively circulate upper ends of said rows of N rods, switching means provided on said means defining the passages for switching the rods from one passage into selected one of adjacent passages, depending on a predetermined sequence, means for depositing warp threads in successive layers C1, C2 . . . C6 between said circular rows of rods, beneath said means defining said circular passages, and means for maintaining and packing the successive layers of warp threads as they are deposited.

The following description with reference to the accompanying drawings given by way of non-limitative examples will explain how the invention may be carried out.

Figure 1:
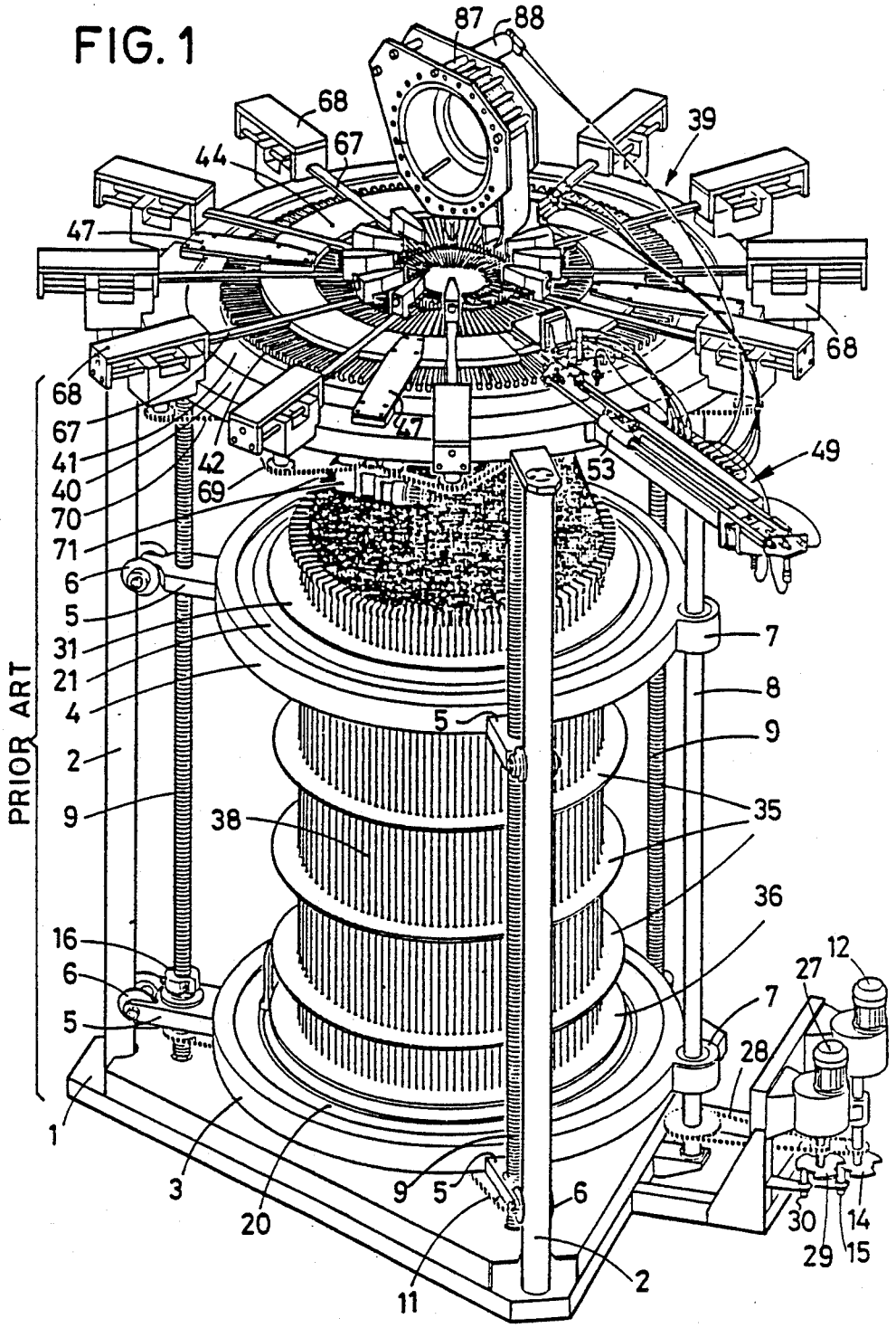
FIG. 1 is an assembly view of a machine according to the prior art.

With reference to the drawings and more particularly to FIG. 1, the machine comprises a frame consisting of a base 1 carrying, in the illustrated embodiment, three vertical guide columns 2 between and on which are mounted horizontal frames 3 and 4 to be slidable from the base upwards.

The frames 3 and 4 each comprise radial lugs 5 carrying a roller 6 in rolling contact with the columns 2. Further, each frame has a boss 7 through which extends a freely rotatable splined shaft 8 for the purpose which will be explained hereinafter.

Figure 3:
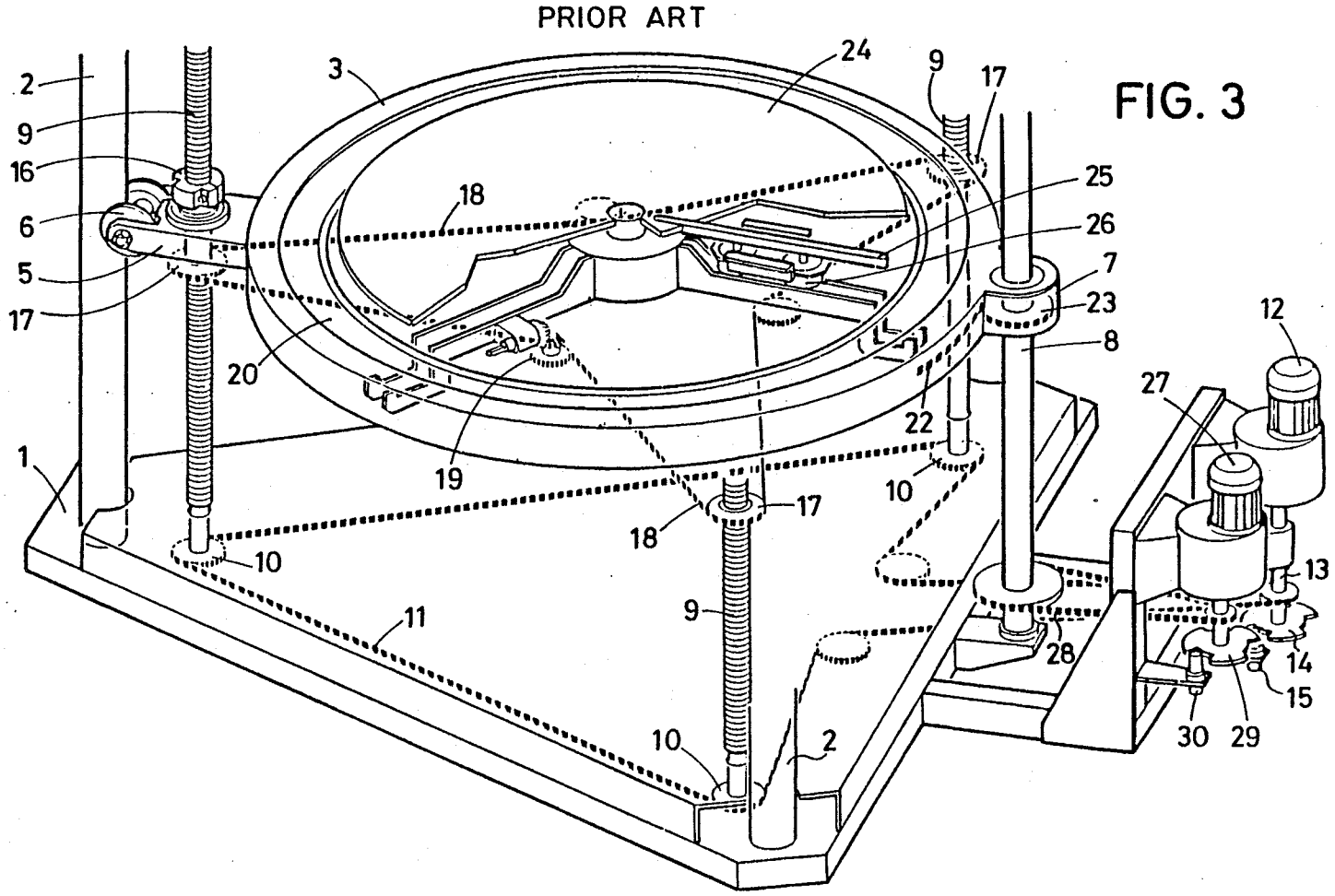
FIG. 3 PRIOR ART
FIG. 3 is a partial view, to an enlarged scale, of the arrangement of the lower frames and the means for driving the frames and the rotary plates, of the machine shown in FIG. 1, and a vibrator whose function will be described hereinafter.

Each lug 5 of the frame 4 is also provided with a tapped hole through which extends a vertical lead-screw 9 on each of which is fixed a chain sprocket pinion 10 engaged with a chain 11 driven by an electric motor 12 having a speed reducer and a shaft 13 carrying at its end a toothed disk 14 rotating in front of a sensor 15 (FIG. 3).

Each lug 5 of the frame 3 has an aperture in which is mounted a block 16 (only one of which is shown in FIG. 3) which is capable of being locked and carries a chain sprocket 17 engaged with a chain 18 having a star-shaped path and extending around a locking device 19 mounted on the frame 3.

With this known assembly, the frames 3 and 4 rise or descend when the screws 9 rotate, the chain 18 being locked and the blocks 16 being free, and only the frame 3 remains in the same position when the screws 9 rotate, the chain 18 being free and the block 16 clamped.

The frames 3 and 4 carry inner rotary rings 20 and 21, respectively, each of which includes outer peripheral teeth 22 meshed with a gear pinion 23 coupled by splines with the shaft 8 (FIG. 3).

The shaft 8 is driven in rotation by an electric motor 27 having a speed reduce through a chain transmission 28, the shaft of the motor 27 carrying a toothed disk 29 rotating in front of a sensor 30.

The rotary ring 20 of the frame 3 carries a disk 24 having a radial slot in which is disposed a bar 25 on the same level as the surface of the disk and connected to an arrangement of electric vibrators 26 so as to vertically vibrate.

Figure 4:
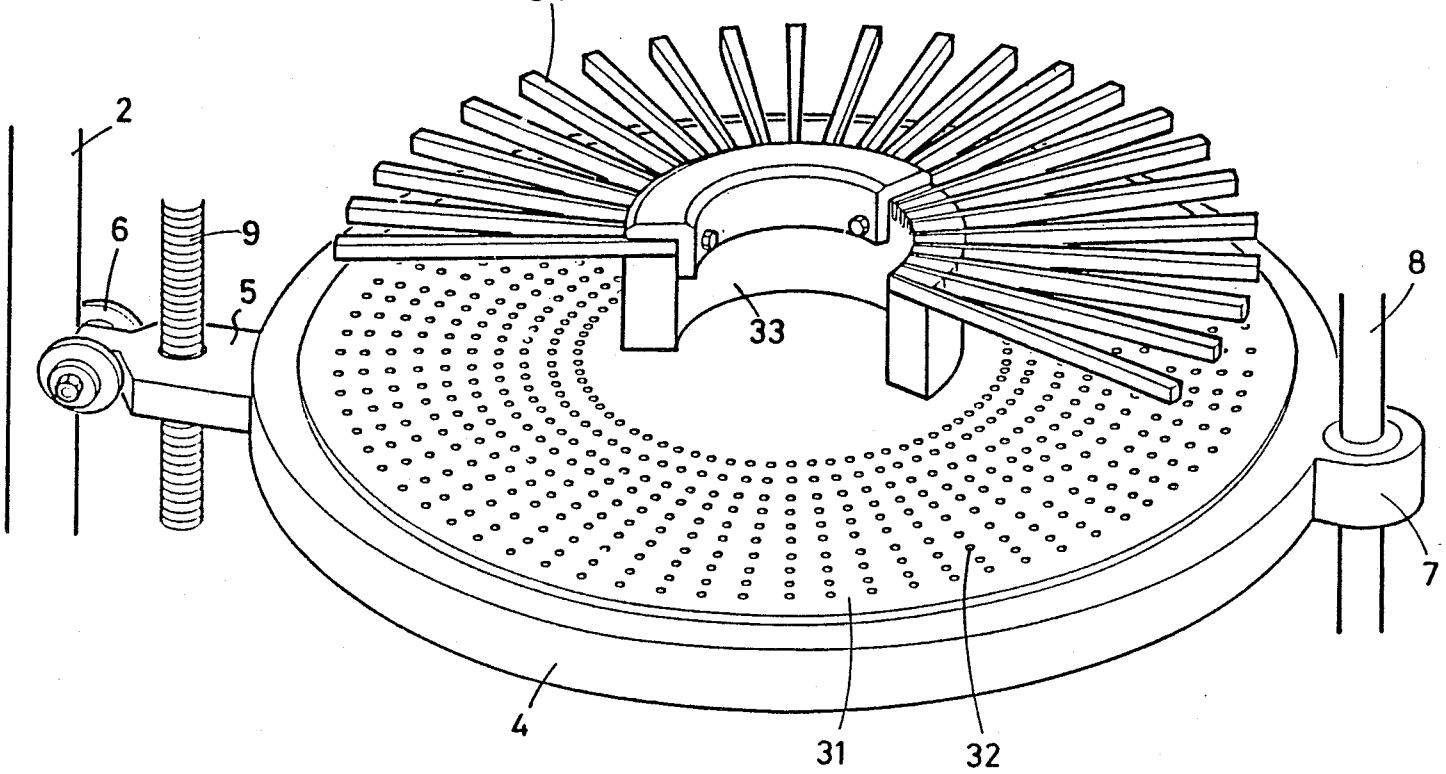
FIG. 4 PRIOR ART
FIG. 4 is a partial view, to an enlarged scale of the machine shown in FIG. 1, showing an intermediate frame and the arrangement of a disk through which the rods supporting the woven element extend.

The rotary ring 21 of the frame 4 carries a disk 31 having apertures 32 aligned in radial and circumferential rows and a central support 33 on which are fixed radially extending strips 34 (FIG. 4) spaced from the disk 31 at a sufficient distance to permit the passage of a device for supplying replacement threads which is not part of the invention and adapted to replace the rods disposed in the orifices 32 by threads, in the known manner in three-dimension weaving machines of the prior art (FIG. 4), such as disclosed in U.S. Pat. No. 4,393,669.

Figure 2:
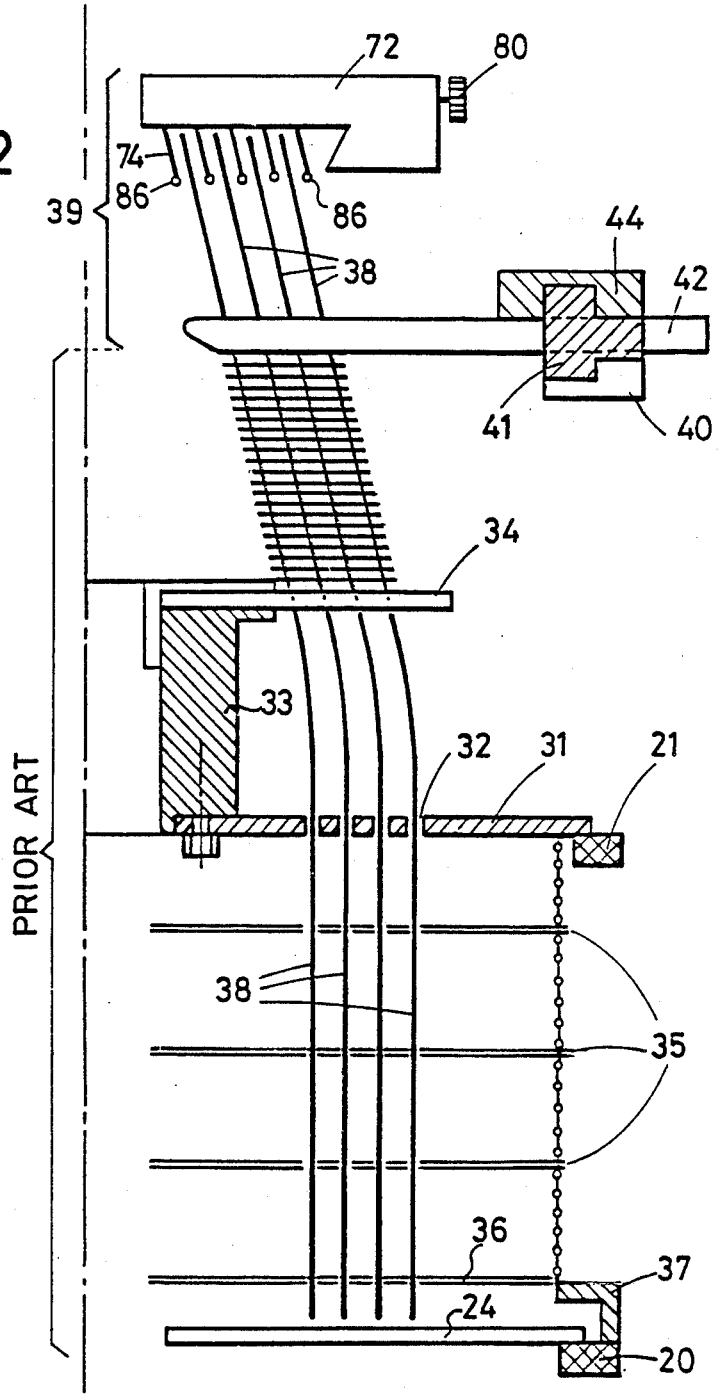
FIG. 2 is a diagrammatic view thereof.

Disposed between the frames 3 and 4 are a plurality of disks 35, 36 having rows of radially and circumferentially aligned orifices in a manner corresponding to orifices 32 of the disk 31, the disks 35 being suspended from the frame 4 by chains and the disk 36 being fixed to the ring 30 of the frame 3 by supports 37 (FIG. 2).

Flexible rods 38 are disposed in the aligned orifices of the stepped disks 31, 35 and 36 and their lower ends bear against the non-perforated disk 34 including the vibrating bar 35. These rods represent the woof threads.

The arrangement described hereinbefore is on the whole similar to that of the machine for weaving reinforcements in three dimensions disclosed in U.S. Pat. Nos. 4,183,232 and 4,346,741.

According to the invention, the machine comprises in its upper part a knitting apparatus fixed to the top of the columns 2 and generally designated by the reference character 9 (FIGS. 1 and 2).

Knitting apparatus

The knitting apparatus 31 comprises a frame 40 similar to the frames 3 and 4 and carrying a rotary ring 41 including radial grooves (FIGS. 2 and 5) in each of which is freely slidable a bar 42, these grooves having a depth which is double the height of the bars.

The bars 42 have a thickness which decreases toward their ends located adjacent to the center of the ring 41 (FIG. 7) and the grooves of the latter are such that the bars extend between the radial rows of rods 38.

At their outer end, the bars 42 have a vertical notch 43 and they are maintained by an annular presser plate 44 whose lower surface has a coating 45 composed of a material having a low coefficient of friction.

Figure 6:
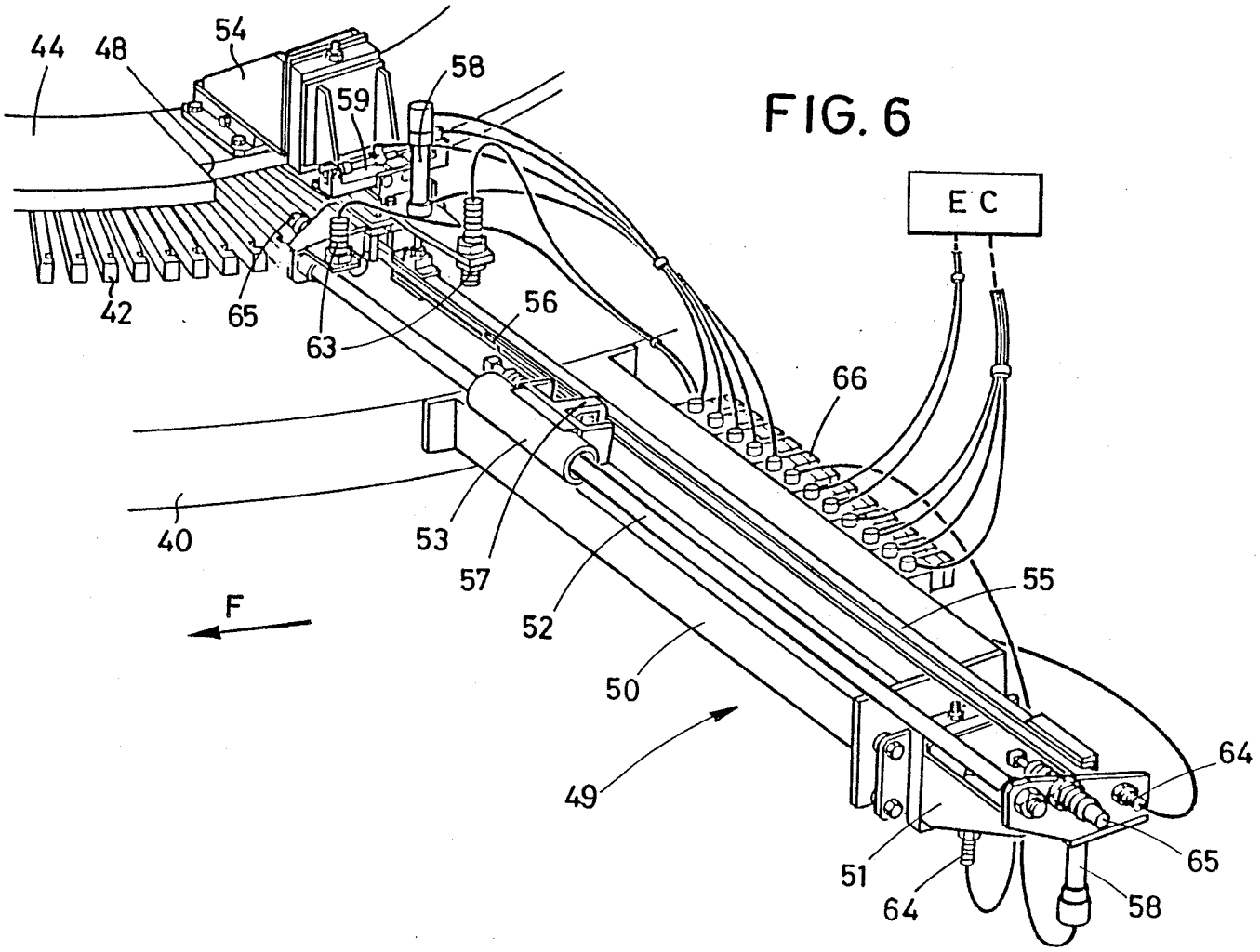
FIG. 6 is a partial view of the device for recycling the strips sliding in the grooved ring.

The plate 44 includes a plurality of radial grooves 46 in its upper surface and is fixed in position by radial support tabs 47 fixed to the frame 40; between two of these grooves, the presser plate 44 has a notch 48 in its outer periphery, in the region of which is mounted a device for recycling the bars 42 generally designated by the reference character 49 (FIG. 6) fixed by one end to the plate 44 and by its opposite end to the frame 40.

Recycling device

This device 49 for recycling the bars 42 comprises a support 50 radially fixed to the periphery of the frame 40 and carrying at its outer end a bracket 51 vertically and horizontally adjustable on the support 50 by two orthogonal slides (not shown) in the known manner.

Fixed on the bracket 51 is an end of a rod 52 on which a driving device 53 is slidable, the opposite end of the rod 52 being fixed t the plate 44 by a second bracket 54 similar to the bracket 51 and also vertically and horizontally adjustable.

A U-sectioned channel 55 is arranged to be parallel to the rod 52 with its opening facing toward the latter. Slidably disposed in this channel is a member 56 fixed to a tab 57 rigid with the driving device 53 so that the latter drives the member 56 along the channel when it travels along the rod 52.

The channel 55 is supported on the brackets 51, 54 by jacks 58 so as to be vertically movable under the action of the latter through a short distance equal to the height of a bar 42, the arrangement being such that the end of the member 56 in the channel 55 is located in facing relation to one of the bars 42 sliding in a groove of the ring 41.

Figure 5:
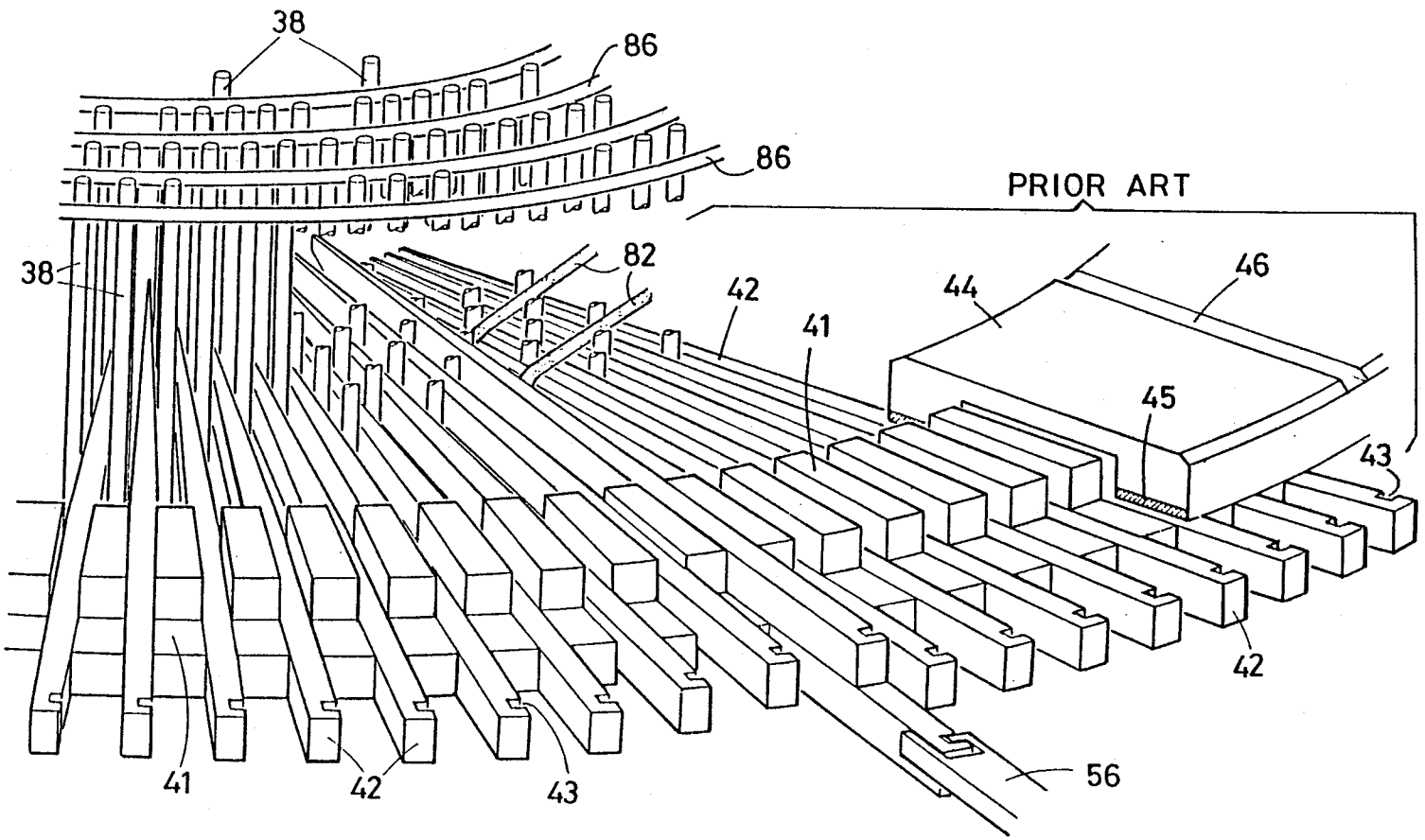
FIG. 5 is a partial view, to an enlarged scale, of the known arrangement of the radially-grooved ring, of the strips sliding in the groves and of the pressing plate, relative to the rods and filaments, in accordance with the invention.

The member 56 has an end extending toward the center of the ring 41 and this end is hook-shaped and complementary to the notch 43 of the bars so as to be capable of hooking into the latter (FIG. 5).

Figure 7:
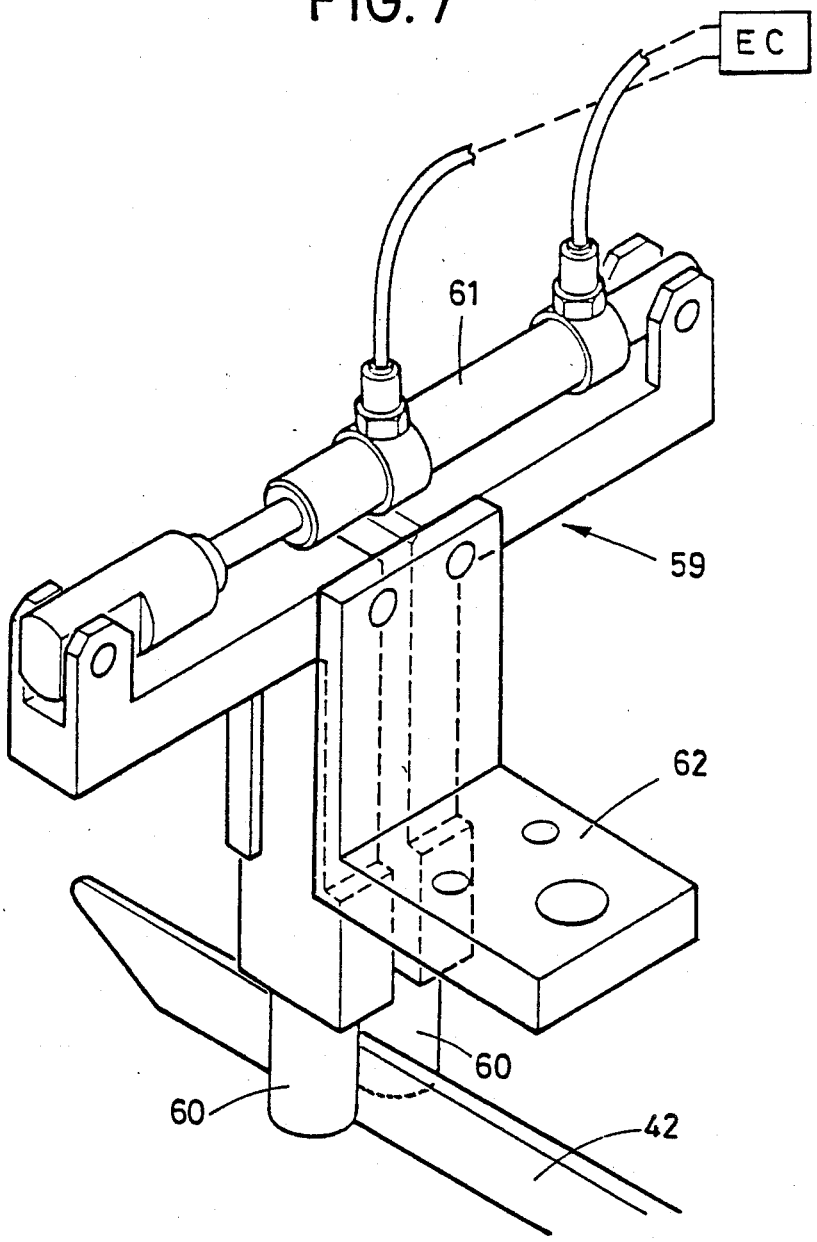
FIG. 7 is a view, to an enlarged scale, of the tongs for guiding the strips which are part of the device for recycling the strips.
Figure 8:
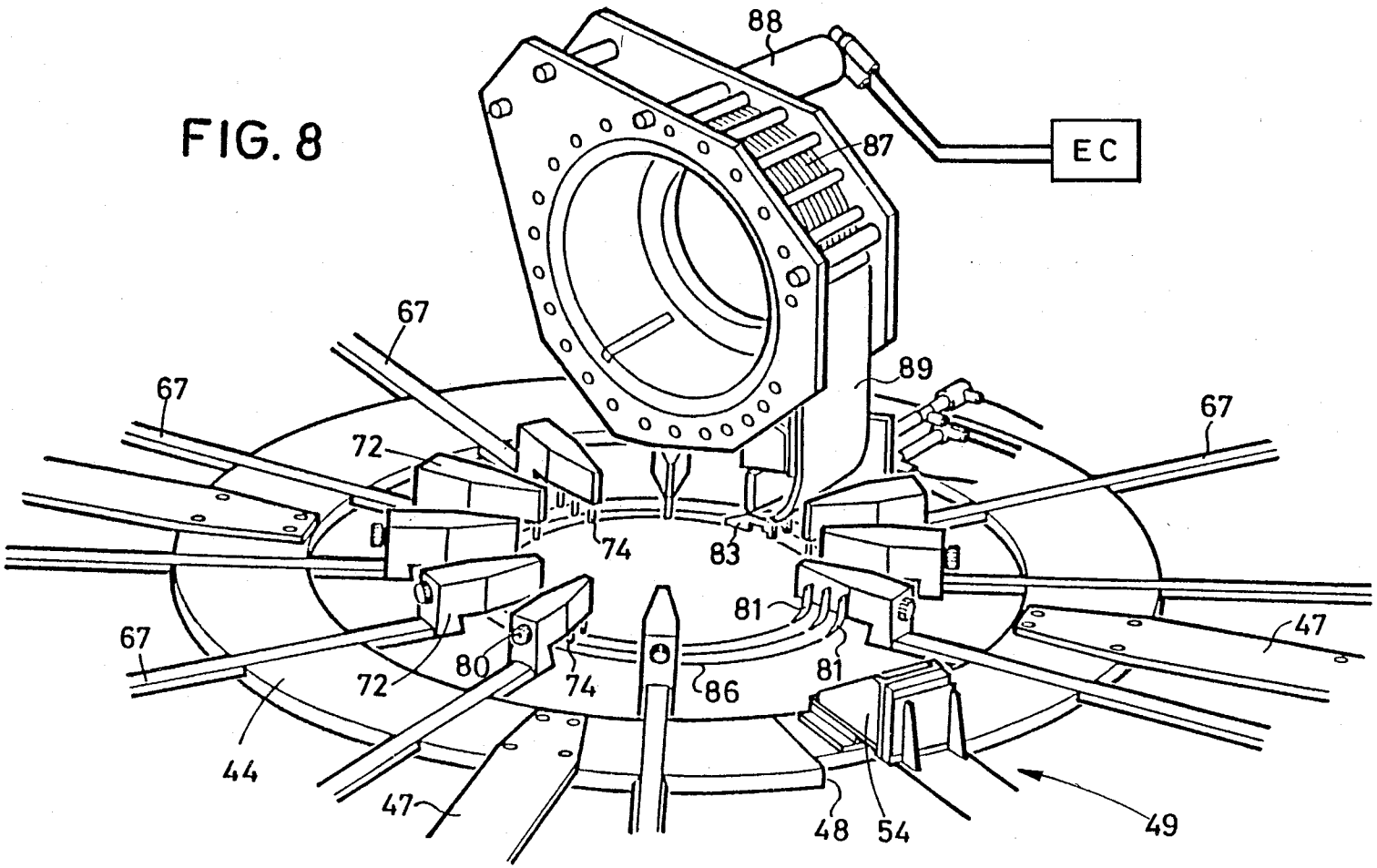
FIG. 8 is a partial view of the upper part of the machine, with the arrangement of the device for regulating the diameter of the reinforcement.
Figure 9:
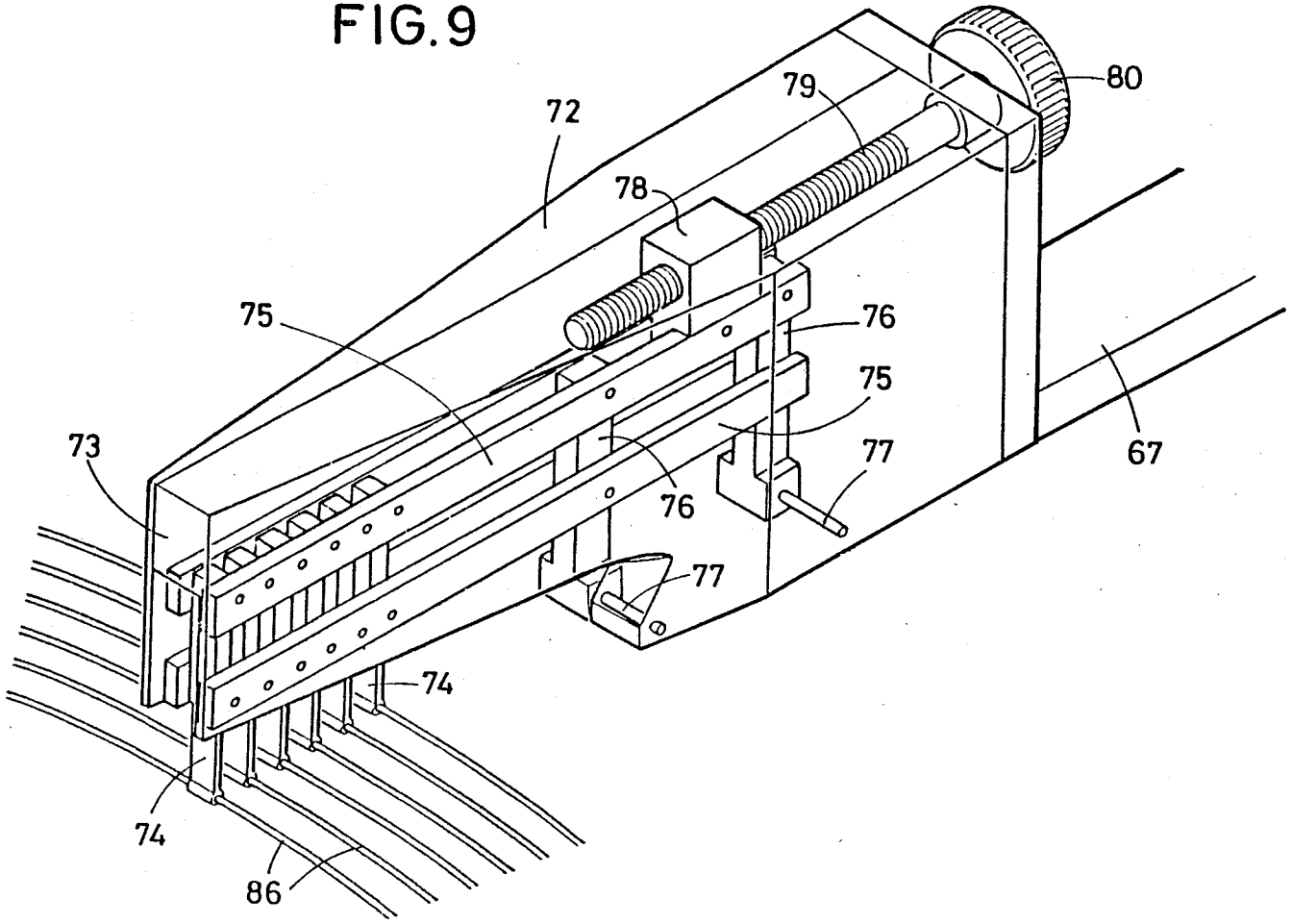
FIG. 9 is a partial view of one of the means for supporting the filaments and displacing the latter.
Figure 10:
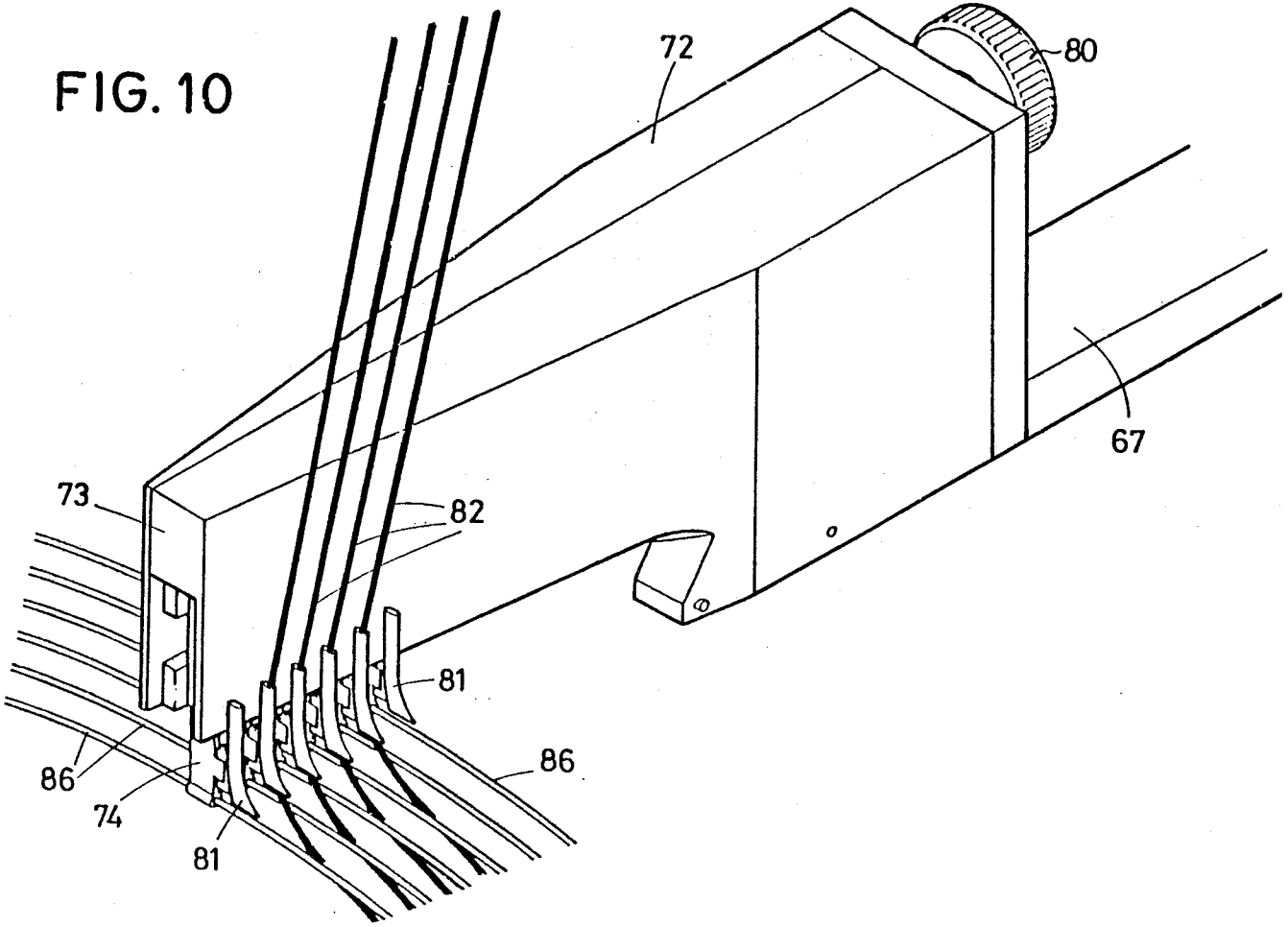
FIG. 10 is a view similar to FIG. 9 also showing the means for guiding the warp threads.
Figure 11:
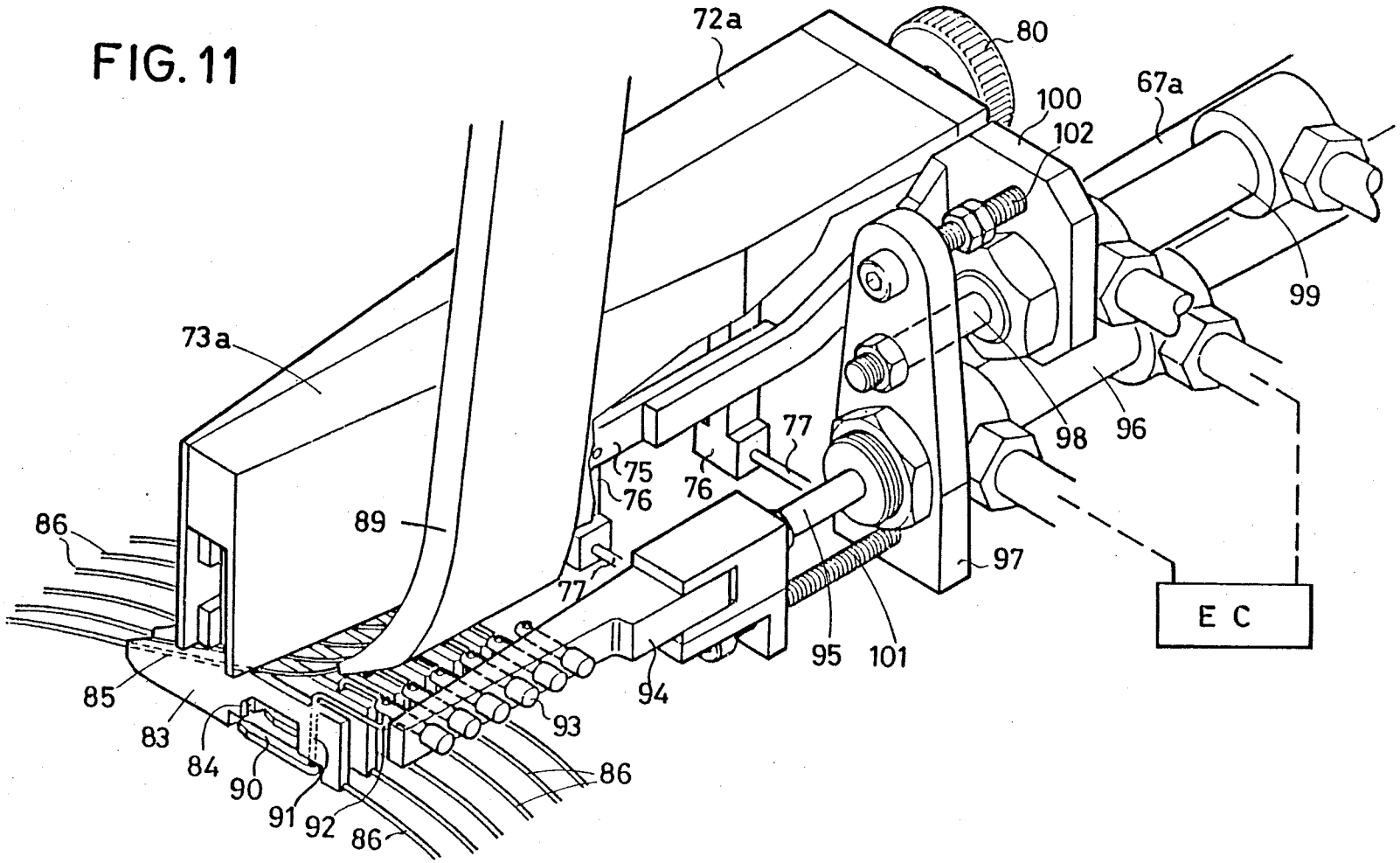
FIG. 11 is also a similar view of the head carrying the needle actuating system.
Figure 12:
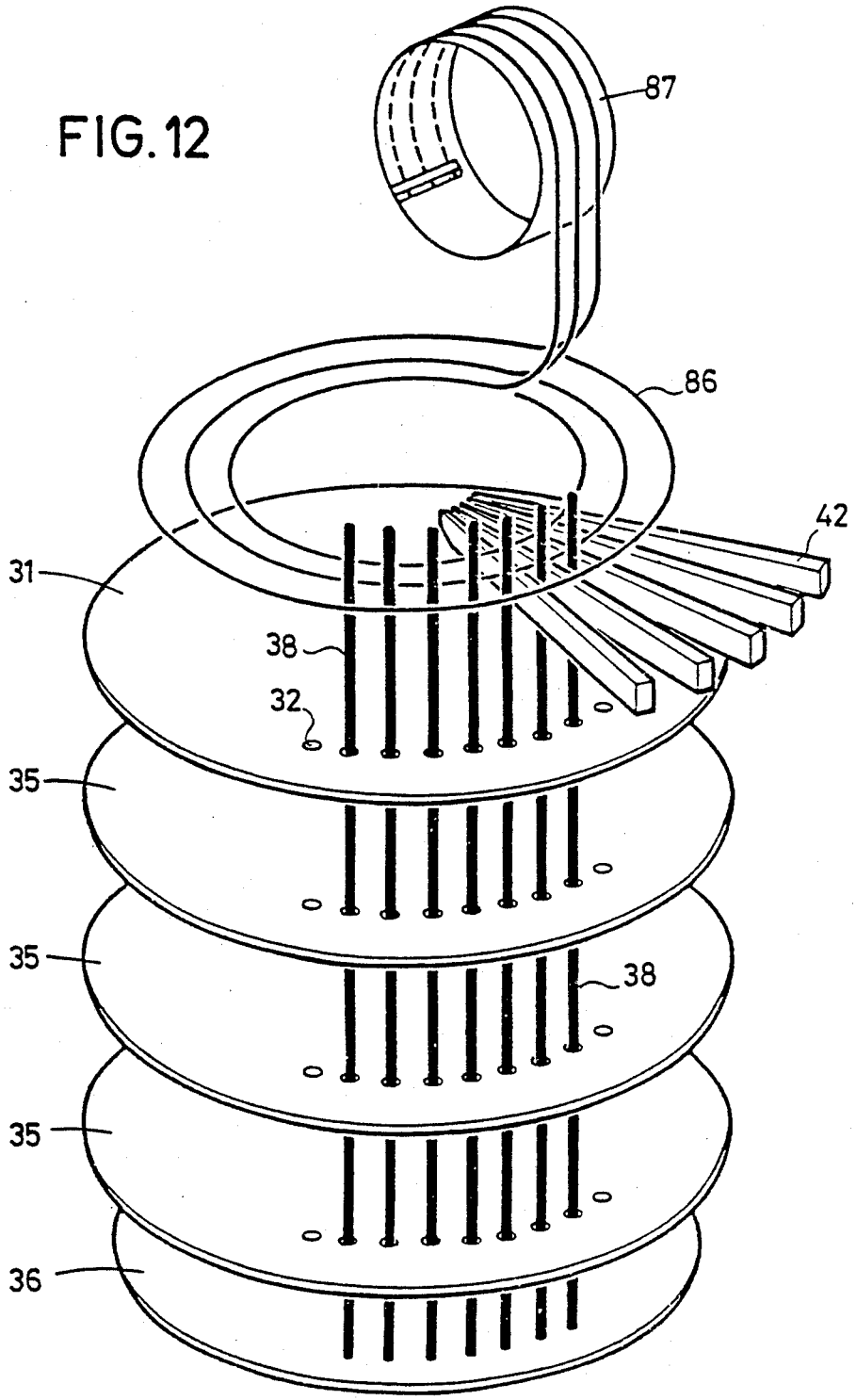
FIG. 12 is a diagram of the machine.
Figure 13:
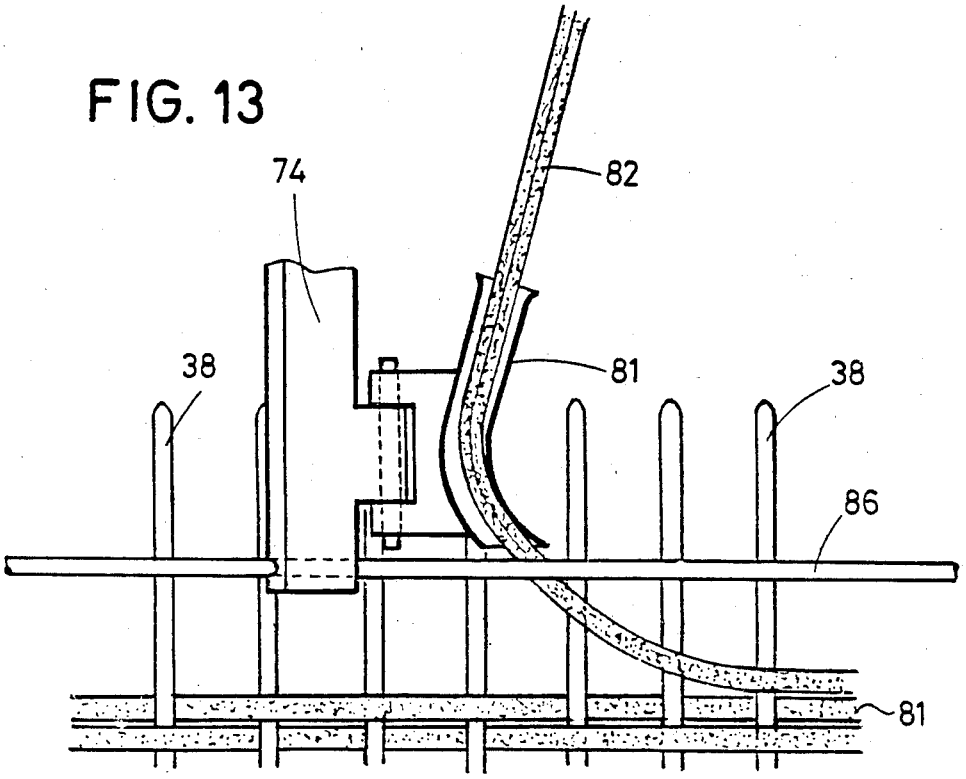
FIG. 13 shows the depositing of a warp thread between the rows of vertical rods.

The device 49 for recycling the bars is completed by a tongs 59 mounted on the bracket 54 and represented in FIG. 7.

This tongs 58 has two vertical branches each provided with a freely rotatable roller 60 at their lower end and so mounted as to be capable of moving toward or away from each other under the action of a low-power pneumatic jack 61. The tongs 59 is fixed to the bracket 54 by an L-shaped member 62 so that the gap between the rollers 60 is located in facing relation to the end of the member 56.

Provided on the brackets 51 and 54 are sensors 63 and 64 for the positions of the driving device 53 and the channel 55, respectively, and shock-absorbers 65 constituting stops for damping the rapid displacements of the device 53.

The pneumatic jacks 58, 61 and the sensors 63, 64 are connected to a connecting element 66 on the support 50 connected to an electronic control device EC, comprised by a computer.

Diameter-regulating device

The knitting apparatus also comprises means for guiding the rods and regulating the diameter of a part knitted on the machine shown in FIGS. 8 to 11.

These means comprise a plurality of radial arms 67 slidably mounted in the grooves 46 of the presser plate 44 and carried at their outer end by actuating devices 68 of the screw-and-nut type mounted on the periphery of the plate 40 and including in their lower part a sprocket 69 engaged with an endless chain 70 which travels through a star-shaped path and is driven by a motor 71 (FIG. 1).

Each radial arm 67 has at its inner end a case 72 (FIGS. 9 and 10) having a hollow nose 73 in which are mounted vertical tabs 74 articulated to two horizontal parallel arms 75 which are articulated to two vertical links 76 pivotally mounted on fixed pins 77 and forming with these arms a parallelogram structure deformable by means of a nut 78 and a screw 79 provided with a knurled knob 80 outside and at the rear of the case 72 for inclining the tabs 74 at ±30° to the vertical without shifting their lower end.

In the illustrated embodiment, there are provided nine radial arms 67 such as those described hereinbefore spaced apart on the periphery of the frame 40, but this number may be different, depending on the size of the machine.

A tenth arm 67 differs from the preceding arms as concerns its tabs 74 each of which carries laterally a guide tube 81 through which passes a warp thread 82 (FIG. 10) coming from a supply reel (not shown) located above the machine. This tenth arm is located before the notch 48 of the plate 44, i.e., before the recycling device 49, with reference to the direction of rotation of the assembly which occurs in the direction from the right to the left as indicated by arrow F of FIG. 6.

An eleventh radial arm **67*a* (FIG. 11) has at the end of its nose 73*a* a plurality of parallel elongated vertical plates 83 each having a notch 84 in its lower edge and arranged to be perpendicular to the axis of the arm 67*a*. The plates 83, as the tabs 74**, are inclinable by the same deformable parallelogram system.

Each plate 83 has within its thickness an oblique passage which is represented in dotted lines at 85, extends from one end of the plate and opens out at its upper edge roughly halfway along its length, and in which is slidable a flexible filament 86, for example constituted by a piano wire coming from a winding and unwinding drum 87 mounted above the radial arm **67*a* and driven by a motor 88; the filaments 86 being guided by a trough 89 toward the passageways 85 of the plates 83**.

The filaments 86 extend, after leaving the passageways 85 of the plates 83, in succession through eyeholes of the tabs 74 of the various radial arms and returns at the opposite end of the plates 83 to which their end is fixed, for example by brazing.

It will be understood that, with this arrangement, the filaments 86 form open horizontal loops which are located above the radial bars 42 and may be made larger or smaller by a synchronized actuation of the motors 71 and 78, the drum 87 supplying or taking up the necessary lengths, as required.

It will be observed that the arrangement is such that the rods 38 extend between the filaments 86 and that the ends of these rods extend beyond the top of the filaments a sufficient distance to be guided therebetween when the rings 20, 21 and 41 and the plates 31, 35 and 36 rotate together. However, this height is a little less than the depth of the notches 84.

The open side of each notch 84 is closed by a needle 90 articulated by its end adjacent to the brazed end of the filament 86 on a vertical pin 91 which is rotatable in a passage provided within the thickness of the plate 83 and formed by a branch of a crank whose crank pin 92 is engaged in a transverse aperture in a pin 93 which is freely rotably mounted in a movable member 94 extending in a direction parallel to the arm **67*a***.

The movable member 94 is fixed to the rod 95 of a first jack whose cylinder 96 is fixed to a member 97 fixed to the rod 98 of a second jack whose cylinder 99 is fixed to a support 100 mounted on the lower arm 75 of the deformable parallelogram structure in the case **72*a*. With this arrangement, the position of the needle 90 is not modified by the inclination of the plates 83**.

Screws 101 and 102 constitute adjustable stops on the member 97 and the support 100, respectively, and enable the travels of the jacks 96 and 99 to be adjusted, these jacks being pneumatic jacks controlled by the aforementioned electronic device.

Operation

First of all, the rods 38 are placed in position bearing against the disk 24 of the frame 3 and extending through the orifices of the various disks and between the bars 42 and the filaments 86, and the end of each warp thread 82 is fixed on the disk 31 of the frame 4 so that the rotation of the latter drives the warp threads.

Before starting a work cycle of the machine, the diameter of the loops formed by the filaments 86 is adjusted by means of the motors 71 and 88.

The motor 27 drives the rings 20, 21 in rotation and all of the intermediate disks with the rods 38, and the warp threads 82 are disposed by the guide tubes 81 between the rows of bars 38.

Simultaneously, a groove of the ring 41 containing a bar 42 is presented in front of the channel 55 which contains an additional bar 42 hooked to the end of the member 56 and is in the upper position, the driving device 53 being shifted back outwardly and the end of the bar 42 being gripped between the rollers 60 of the tongs 59. The motor 27 stops.

The device 53 drives the member 56 which urges the bar 42 contained in the channel 55 toward the center of the machine and the rollers of the tongs move apart and this bar 42 comes to be disposed in the groove of the ring 41 on top of the bar 42 which is already in this groove above the layer of warp threads owing to the convergent shape of its end.

The jacks 68 then lower the channel 55 and the end of the member 56 is hooked onto the bar 42 at the bottom of the groove.

As the branches of the tongs are open, the device 53 moves back along the rod 52 and drives this bar 42 in the channel, which the jacks 58 then raise to the upper position and the tongs again grips the end of the bar.

This cycle is repeated each time the motor 27 brings a groove of the ring 41 in front of the channel.

While this sequence of the recycling of the bars 42 occurs, the rods 38 advance in the passages A, B, C . . . defined by the filaments 86 which guide them, and the motor 12 drives the screws 9 for lowering the frame 4 a distance corresponding to the thickness of the deposited layer of warp threads 82, this distance corresponding to a given number of rotations of the disk 14 in front of the sensor 15.

While the rods 39 travel along the passages between the filaments 86, the thread guides 81 deposit the warp threads 82 under the filaments between the circular rows of rods 38 on the bars 42 which are placed back on top of the threads 82, one after the other by the bar-recycling device 49 between the radial rows of the bars.

Figure 14:
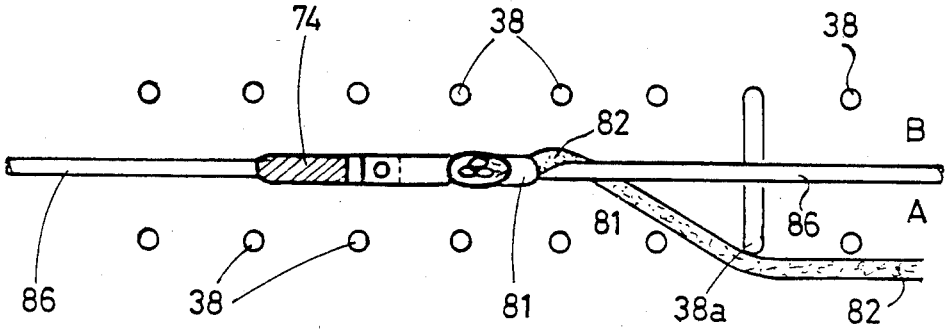
FIG. 14 is a similar top plan view of the rods and a warp thread.
Figure 16:
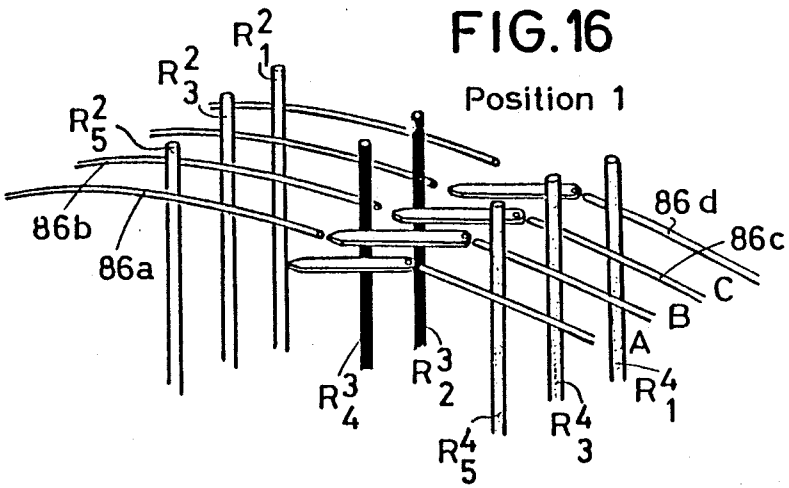
FIGS. 15, 16, 17 and 18 show the relative positions of the rods, the filaments and the needles in different stages of the operation for weaving a reinforcement element.
Figure 15:
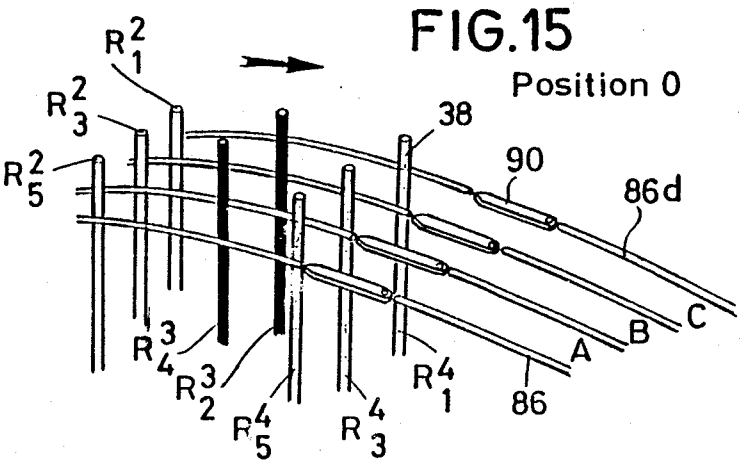
Figure 18:
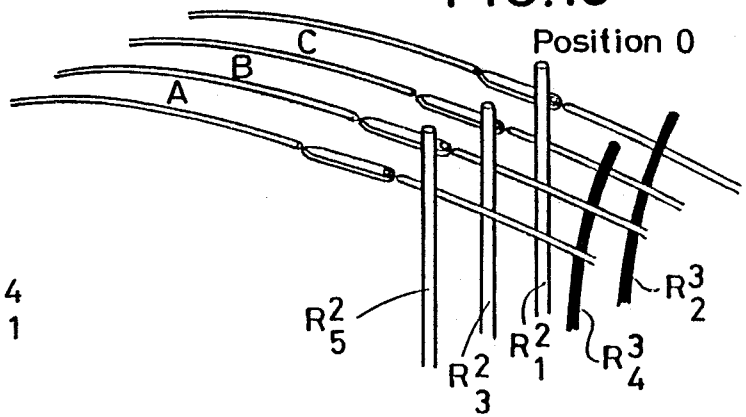
Figure 17:
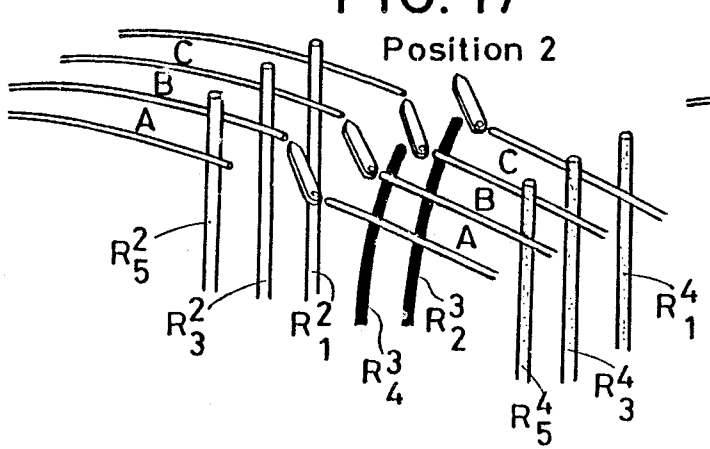

In the course of the rotation of the assembly, the needles 90 are shifted by the jacks 96 and 99 by pivoting about the pins 91 so as to pass the flexible rods 38 of the radial rows from one passage to the other in the manner of a switching by bending them in accordance with a predetermined sequence stored in the memory of the electronic device so as to constrain the warp threads 82 to place themselves in another passage during a part of the rotation of the assembly as diagrammatically shown in FIG. 14 which shows a rod 38*a* which has been deviated to pass from the passage B into the passage A by a needle 90.

Figure 19:
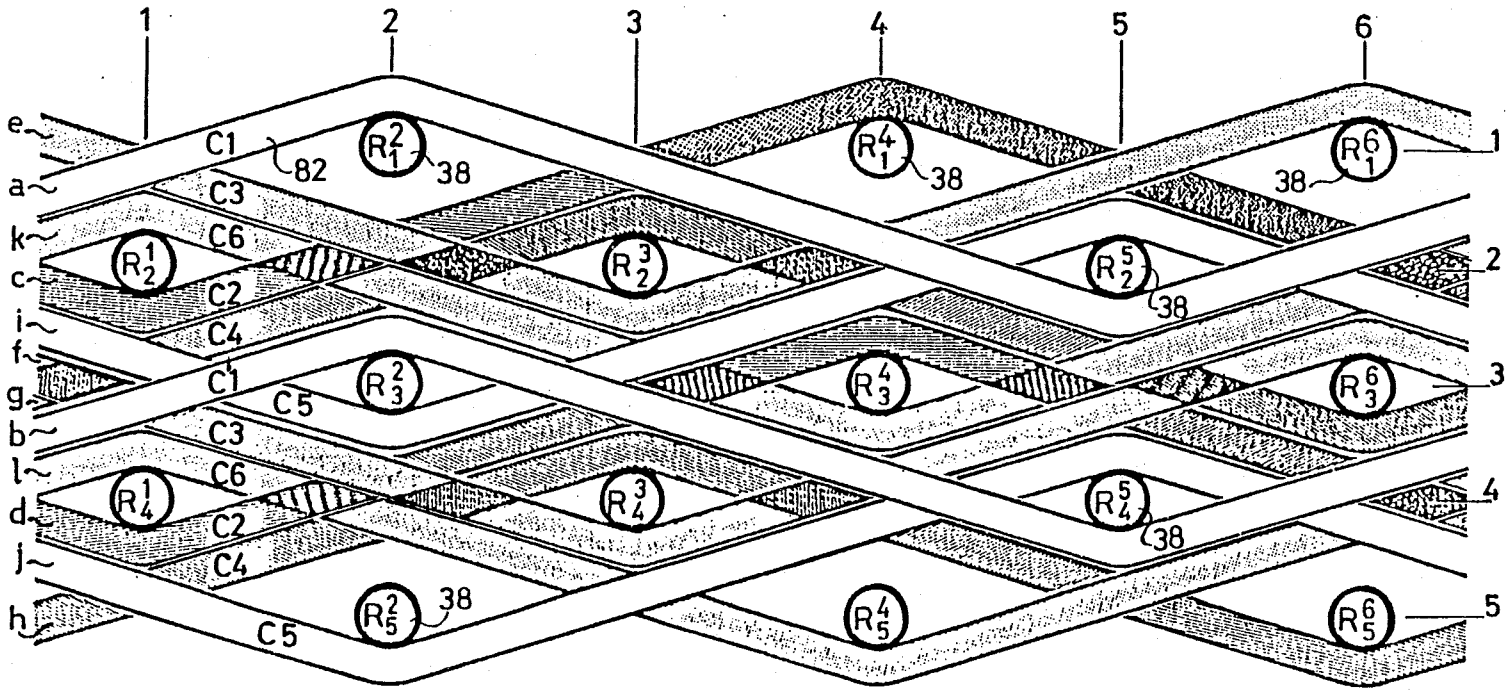
FIG. 19 is a view to a large scale of the texture of the basic pattern of the reinforcement woven by the machine according to the invention.

The sequence of the switching and bending of the upper parts of the rods 38 is predetermined in order to obtain the arrangement of the warp threads a, b, c, . . . 1 producing the texture represented in FIG. 19 in which the woof threads $R_5^2$, $R_3^2$, $R_1^2$ of the column 2, $R_4^3$, $R_2^3$ of the column 3 and $R_5^4$, $R_3^4$, $R_1^4$ of the column 4 correspond to the rods 38 (FIGS. 15 to 18).

If N designates the number of rods 38 in a circumferential passage A, B or C, and if the positions of the needles 90 are designated by 0 when they are aligned with the filaments to which they correspond, by 1 when they are oriented toward the center of the machine, by 2 when they are oriented toward the exterior, the sequence of the displacements of the needles for producing the arrangement of the various layers C1 to C6 forming the reinforcement shown in FIG. 19, will be the following during six complete revolutions of the assembly, namely for the basic pattern:

For the layer C1: 1, 1, 0, 0, 0, 1×N/6
For the layer C2: 0, 2, 2, 0, 1, 1×N/6
For the layer C3: 2, 0, 1, 1, 0, 2×N/6
For the layer C4: 0, 2, 2, 2, 0, 0×N/6
For the layer C5: 1, 1, 0, 2, 2, 0×N/6
For the layer C6: 2, 0, 1, 1, 0, 2×N/6

After any rod 38 has been switched into another circular passage, this rod remains in this passage during a complete rotation of the assembly.

When the weaving of the reinforcement has started and a plurality of layers of warp threads has been deposited, the jamming of the threads 82 relative to the rods 38 is then such that it is then possible to slightly lower the lower frame 3 by actuating the device 19 so as to move the disk 24 slightly away from the lower ends of the rods 38. This disk is then prevented from rotating and the vibrators 26 are actuated and maintained in operation throughout the duration of the weaving of the reinforcement.

The frame 4 is then lowered for bringing the lower ends of the rods 38 into contact with the disk 24, then, after each complete rotation of the assembly, the frame 4 is lowered a distance less than the amplitude of the vibrations of the bar 25.

When the rods 38 of a radial row come into contact with a bar 25, the vibrations of the latter causes them to rise and slide between the already-deposited warp threads without entraining along therewith the layers of threads which are held stationary by friction on the other rods 38 not in contact with the bar 25.

If the reinforcement to be produced has a non-constant diameter, the diameter of the loops formed by the filaments is adjusted at the required moments by actuating the motor 71, and the angle of the tabs 74 and plates 83 by actuating the knobs 80 and the height of the frame 3 is adjusted by actuating the device 19.

When the height of the reinforcement is reached, the machine is stopped and each rod 38 is replaced by the appropriate length of woof thread, as it is already known per se and for example described in U.S. Pat. No. 4,393,669.

In the described embodiment, the plate 40 carrying the knitting apparatus is fixed to the upper part of the machine. In a modification (not shown), this plate may also be movable in height on the columns 2. In this modification, the screws 9 are fixed and each frame is then provided with an individual motor.

It will be understood that the electronic device may be a computer of any known type suitably programmed for controlling the various elements of the machine in accordance with the required sequence.

What is claimed is:

1. A machine for knitting composite reinforcements with woof threads and warp threads having a texture formed by a basic pattern constituted by fifteen woof threads R arranged in staggered relation forming six columns 1 to 6 of alternately two and three threads and at least five lines 1 to 5 perpendicular to said columns and each having three threads, and by six imbricated layers C1 to C6 of at least two parallel warp threads, namely at least twelve threads a, b, c . . . 1 each connecting every third woof thread of the same column in two adjacent lines and the warp threads of the consecutive layers connecting woof threads in alternated columns, the first thread a of the first layer C1 connecting the woof thread R of column 2 in line 1, namely $R_1^2$ to the woof thread R of column 5 in line 2, namely $R_2^5$; the second thread b of the first layer C1 connecting the woof thread R of column 2 in line 3, namely $R_3^2$, to the woof thread R of column 5 in line 4, namely $R_4^5$; the first thread c of the second layer C2 connecting the woof thread R of column 1 in line 2, namely $R_2^1$, to the woof thread R of column 4 in line 1, namely $R_1^4$; the second thread d of the second layer C2 likewise connecting the woof threads $R_4^1$ and $R_3^4$, the paths of the threads of the following layers C3 . . . C6 being obtained by adding 2 to each preceding corresponding column reference, namely, for the first thread of layer $C3=R_2^{1+2}=R_2^3$ and $R_1^{4+2}=R_1^6$, etc., this pattern being capable of being enlarged in the direction of the thickness of the material to be produced with an uneven number of lines, said machine being of the type comprising a frame having a plurality of vertical columns, horizontal frames spaced apart one above the other and in guided relation to the columns, rotary disks provided with circular rows of radially aligned orifices and carried by the frames, corresponding rows of N vertical rods disposed in the orifices, and a knitting apparatus mounted in an upper part of said columns and comprising an annular ring having radial grooves, bars slidably mounted the grooves, an annular pressure plate for maintaining said bars, and a device for recycling the said oars, said machine comprising in an upper part thereof a fixed frame, means carried by the frame and defining therebetween horizontal concentric passages in which respectively circulate upper ends of said rows of N rods, switching means provided on said means defining the passages for switching the rods from one passage into selected one of adjacent passages, depending on a predetermined sequence, means for depositing warp threads in successive layers C1, C2 . . . C6 between said circular rows of rods, beneath said means defining said circular passages, and means for maintaining and packing the successive layers of warp threads as they are deposited.

2. A machine according to claim 1, whrein the means defining the passages comprise filaments each forming a circular loop having a gap in which gap said switching means are mounted, and a device for carrying the filaments and adjusting the diameter of said loops.

3. A machine according to claim 2, wherein the device for carrying the filaments and adjusting the diameter of said loops comprises supports fixed to the periphery of said frame, radially adjustable movable horizontal arms carried by the supports and each having an end oriented toward the interior of the frame, a head provided at said end, and inclinable vertical tabs mounted on the head, the filaments being suspended from the head by the tabs.

4. A machine according to claim S, comprising parallel arms to which the tabs are articulated, the tabs and the parallel arms together forming a deformable parallelogram structure mounted in said head, and a screw associated with the parallelogram structure for adjusting it.

5. A machine according to claim 4, comprising an additional arm, horizontally elongated vertical plates mounted on the additional arm from which plates said filaments are also suspended, said vertical plates having a lower edge defining a notch constituting said gap of said loops formed by the filaments.

6. A machine according to claim 5, comprising a drum and a motor drivingly connected to the drum and mounted above the machine, each filament having an end fixed to the drum, an oblique passage provided within the thickness of each vertical plate and opening out at an end of the vertical plate, the filaments extending through said passages in said plates and returning to an opposite end of the vertical plates to which opposite end the are fixed by an opposite end of the filaments.

7. A machine according to claim 5, wherein said notch has a depth a little greater than the height of the ends of the rods above the filaments, and said switching means comprise a needle having an end articulated to the lower edge of each vertical plate and movable between a position 0 for closing the notch and two other positions 1 and 2 for opening the notch, on one side and the other of the vertical plate, respectively.

8. A machine according to claim 7, comprising a vertical pin freely rotatably mounted on each vertical plate, an actuating device comprising two jacks connected in series, the respective needle being fixed to said pin and a crank connecting said actuating device to said pin for shifting said needle.

9. A machine according to claim 4, comprising a warp thread supply source, said means for depositing the warp threads comprising vertical guide tubes which are laterally fixed to tabs of one of the arms and through which extend the threads coming from said supply source.

10. A machine according to claim 1, wherein said means for maintaining and packing the layers of warp threads comprises said sliding bars, which extend between the radial rows of rods and below the filaments and said device for recycling the bars, which is adapted for successively withdrawing the bars add placing them again on said layers.

11. A machine according to claim 10, wherein the recycling device comprises a radial support which is fixed to a periphery of the frame and to the plate, a vertically movable radial channel carried by the support, a member slidable in said channel, and an actuator drivingly connected to said member, said member being adapted to come into engagement with the bars.

12. A machine according to claim 11, wherein supports mount the recycling device on the frame and the plate, said supports being adjustable along two orthogonal axes, the recycling device comprising tongs for guiding the bars.

13. A machine according to claim 1, wherein said predetermined sequence for switching the rods between the passages by orienting the needles in said position and for depositing the layers of warp threads C1 to C6 is the following for six complete rotations of the assembly, namely for the basic pattern:

For the layer C1: 1, 1, 0, 0, 0, 1×N/6
For the layer C2: 0, 2, 2, 0, 1, 1×N/6
For the layer C3: 2, 0, 1, 1, 0, 2×N/6
For the layer C4: 0, 2, 2, 2, 0, 0×N/6
For the layer C5: 1, 1, 0, 2, 2, 0×N/6
For the layer C6: 2, 0, 1, 1, 0, 2×N/6

14. A machine according to claim 13, wherein said electronic device is a computer.

* * * * *